United States Patent [19]

Saito et al.

[11] Patent Number: 4,673,444

[45] Date of Patent: Jun. 16, 1987

[54] PROCESS FOR PHOSPHATING METAL SURFACES

[76] Inventors: Koichi Saito; Yasutake Mino; Ryoichi Murakami, all of c/o Nippon Paint Co., Ltd., 19-17 Ikedanakamachi, Japan

[21] Appl. No.: 783,059

[22] Filed: Oct. 1, 1985

Related U.S. Application Data

[63] Continuation of Ser. No. 525,852, Aug. 23, 1983, abandoned, which is a continuation-in-part of Ser. No. 358,065, Mar. 12, 1982, abandoned.

[30] Foreign Application Priority Data

Mar. 16, 1981 [JP] Japan ..... 56-38411
Aug. 22, 1983 [EP] European Pat. Off. ..... 83304846.5

[51] Int. Cl.[4] ..... C23C 22/14
[52] U.S. Cl. ..... 148/6.15 Z
[58] Field of Search ..... 148/6.15 Z

[56] References Cited

U.S. PATENT DOCUMENTS 4,292,096 9/1981 Murakami ..... 148/6.15 Z
4,338,141 7/1982 Senzaki ..... 148/6.15 Z
4,389,260 6/1983 Hauffe et al. ..... 148/6.15 Z

FOREIGN PATENT DOCUMENTS 2072225 9/1981 United Kingdom .

*Primary Examiner*—Sam Silverberg
*Attorney, Agent, or Firm*—Ernest G. Szoke; Henry E. Millson, Jr.

[57] ABSTRACT

A method of phosphating the surfaces of iron-based metals, zinc-based metals, or combinations of such surfaces by contacting the metal surfaces with an acidic aqueous phosphating solution containing from about 0.1 to about 2.0 g/l of zinc ion, from about 5 to about 30 g/l of phosphate ion, from about 0.2 to about 3 g/l of manganese ion, and a conversion coating accelerator. The phosphated metal surfaces are then suitable for electrocoating.

19 Claims, No Drawings

PROCESS FOR PHOSPHATING METAL SURFACES

This application is a continuation of Ser. No. 525,582 filed 8/23/83 now abandoned which is a continuation-in-part of Ser. No. 358,065 filed 3/12/82 now abandoned.

BACKGROUND OF THE INVENTION

Nippon Paint Co., Ltd. of Osaka, Japan recently filed Japanese Patent Publications (unexamined) Nos. 107784/1980 and 152183/1980 on phosphating methods of treating iron-based metal surfaces which are particularly suitable for treating manufactured products having complicated surfaces, such as automobile bodies. The above phosphating methods are in use commercially in the automotive industry for pretreating automobile bodies prior to cationic electrocoating, which are the coating processes now used extensively in this industry. The phosphating method of Japanese Patent Publication No. 107784/1980 is carried out by first subjecting the metal surface to a dipping treatment with an acidic aqueous solution containing 0.5 to 1.5 g/l of zinc ion, 5 to 30 g/l of phosphate ion, and 0.01 to 0.2 g/l of nitrite ion and/or 0.05 to 2 g/l of m-nitrobenzene-sulfonate ion at a bath temperature of 40° to 70° C. for 15 seconds or more, followed by spraying with the above solution for 2 seconds or more. The other method, i.e. the method of Japanese Patent Publication No. 152183/80, comprises spraying onto the metal surface an acidic aqueous solution containing 0.4 to 1.0 g/l of zinc ion, 5 to 40 g/l of phosphate ion, 0.01 to 0.2 g/l of nitrite ion and 2.0 to 5.0 g/l of chlorate ion at 40° to 70° C. for 40 seconds or more.

Recently, in the automotive industry, consistent with the aim of further improving corrosion resistance after the application of a siccative coating, steel components which are plated on one surface only with zinc or a zinc alloy have come to be used as materials for automobile bodies. When the processes of the above Japanese Patent Publications are applied to such materials (i.e. to metal components having both iron-based metal surfaces and zinc-based metal surfaces), the iron-based surfaces are provided with a phophate coating film having a low film thickness with uniform and dense cubic or plate-like crystals, as well as excellent adhesion and corrosion-resistance. Such phosphate coating on the iron-based surface is suitable as a substrate for cationic electrocoating. However, in the case of the phosphate coating film formed on the zinc-based surfaces, the resistance to salt water spraying after the application of a cationic electrocoating thereto is insufficient, and secondary adhesion (by immersion test of the film with cross-hatched scratches in warm water) after cationic electrocoating - intermediate coating - top coating is greatly inferior to that on the iron-based surfaces. In addition to the above Japanese Patent Publications, the following references disclose phosphating compositions for metal surfaces:

U.S. Pat. No. 3,338,755 issued Aug. 29, 1967 to Jenkins et al. This patent discloses a process for phosphating metal surfaces with a phosphating solution containing zinc, manganese, phosphate, nitrate, and nitrite, as essential ingredients, in stated proportions.

U.K. No. 983,924 issued Feb. 24, 1965 to Pyrene Co., Ltd. is by the same inventors as U.S. Pat. No. 3,338,755 and has the same general disclosure.

German No. 29 31 693, issued Dec. 11, 1980 to Fosfa-Col, discloses a phosphating process using a solution containing zinc, manganese, phosphate, nitrate, and chlorate ions in stated gram-atom relationships. However, none of the above proposed phosphating methods have succeeded in giving satisfactory results with the above combination of substrate materials.

Japanese Patent No. J50139-039 (JA No. 197511) discloses a conversion coating solution containing manganese ions for the treatment of zinc surfaces. However, this prior art solution contains from 3 to 20 g/l of zinc ions, which will result in a conversion coating having leaf-like crystals on iron-based surfaces. Such leaf-like crystals are unsuitable as a substrate for cationic electrocoating. Hence, the solutions of this patent are unsuitable for treating both zinc-based and iron-based surfaces.

DETAILED DESCRIPTION OF THE INVENTION

The present inventors have now surprisingly found that by the inclusion of defined quantities of manganese ion in certain acidic aqueous phosphating solutions, very satisfactory results can be attained with these materials, and that such aqueous solutions containing zinc ion, phosphate ion, manganese ion and a conversion coating accelerator can be applied either by dipping, spraying, or a combination thereof. The inventors have further found that while chlorate ion can be present as well, it is not an essential component of the treating solution for spray applications, provided the defined amounts of manganese ion are present therein, and that even when chlorate ion is added in a preferred embodiment, the amounts of said ion can be markedly decreased as compared with those of heretofore known compositions.

Accordingly, the present invention relates to a treating method for forming phosphate coatings on metal surfaces. More particularly, it relates to a treating method for surfaces of a metal such as a car body which have both iron-based surfaces and zinc-based surfaces, and to aqueous treating compositions, concentrates useful in their preparation, and to the phosphate coating films resulting from their use. The treating method of the invention is especially designed for forming phosphate coating films suitable for electrocoating, particularly cationic electrocoating.

The process of the invention is carried out by contacting the metal surface(s) to be phosphated with an acidic aqueous solution containing:

(a) from about 0.1 to about 2.0 g/l, preferably about 0.5 to about 1.5 g/l, and more preferably about 0.7 to about 1.2 g/l of zinc ion;

(b) from about 5 to about 30 g/l, preferably about 10 to about 20 g/l of phosphate ion;

(c) from about 0.2 to about 3 g/l, preferably about 0.6 to about 3 g/l, and more preferably about 0.8 to about 2 g/l of manganese ion; and (d) a conversion coating accelerator which is at least one of the following:

(i) from about 0.01 to about 0.2 g/l, preferably about 0.04 to about 0.15 g/l, of nitrite ion;

(ii) from about 0.05 to about 2 g/l, preferably about 0.1 to about 1.5 g/l, of m-nitrobenzene-sulfonate ion; and (iii) from about 0.5 to about 5 g/l, preferably about 1 to about 4 g/l, of hydrogen peroxide (based on 100% $H_2O_2$).

The metal surface(s) can be contacted with the acidic aqueous solution of the invention by spraying the solution onto the surface of the metal, by dipping the metal surface into the solution, or by a combination of dipping and spraying steps: Optionally, the above acidic aqueous solution may also contain one or more of the following:

(e) from about 0.1 to about 4 g/l, preferably about 0.3 to about 2 g/l, of nickel ion;

(f) from about 1 to about 10 g/l, preferably about 2 to about 8 g/l, of nitrate ion; and (g) from about 0.05 to about 3 g/l, preferably about 0.05 to about 1.9 g/l, and more preferably about 0.2 to about 1.5 g/l, of chlorate ion for both dipping and spraying use. However, where a spray process is used with a zinc ion concentration of more than 1 g/l, i.e. from more than 1.0 to about 2.0 g/l of zinc ion, then up to about 5 g/l of chlorate ion, e.g. from about 2 g/l to about 5 g/l, can be present in the solution. Use of chlorate concentrations in excess of these ranges is not advisable since at higher chlorate levels the phosphating rate becomes too rapid for satisfactory control.

The above process is carried out at a temperature of from about 40° to about 70° C., preferably about 45° to about 60° C., for a contact time of at least 5 seconds, preferably at least 15 seconds, and more preferably about 30 to about 180 seconds, and most preferably about 30 to about 120 seconds, as hereinafter discussed. The period of treatment is generally at least about 15 seconds for dipping and at least about 5 seconds for spraying. It should be noted that at temperatures below about 40° C., coatings can be formed; however the coating is sparse, coating formation is relatively slow and longer times are required to form satisfactory coatings. At temperatures above 70° C., the conversion coating accelerators begin to decompose at an unacceptable rate, changing the composition of the solution and resulting in an unacceptable conversion coating. Also, precipitates begin to form in the bath.

Following the above treatment, the phosphated metal surface(s) are then coated with a siccative coating by a known electrocoating process, preferably by the cationic electrocoating process.

The term "metal surface(s)" as used herein is understood to mean iron-based surfaces, iron alloy-based surfaces, zinc-based surfaces, and zinc alloy-based surfaces. Zinc-based and zinc alloy-based surfaces include, for example, zinc plated steel plate formed by hot dipping, alloyed zinc plated steel plate formed by hot dipping, zinc plated steel plate formed by electroplating, alloyed zinc plated steel plate formed by electroplating, etc.

Additionally, an important advantage of the present invention is that surfaces of metal components such as car bodies that contain both iron-based surfaces and zinc-based surfaces, can be treated by the process of the invention with excellent results. In fact, the process of the invention produces better conversion coatings than are obtainable with conventional dip or spray treating processes, and the amount of etching of the metal surfaces during the present process is only ⅔ to 4/5 that of conventional processes, so that both the quantity of chemicals used in the process as well as sludge formation is only from ⅔ to 4/5 that of conventional processes. Needless to say, however, the process of the present invention is not limited to the treatment of metal components having both iron-based and zinc-based surfaces, i.e., the present process is equally applicable to the treatment of a single metal surface of a type described above.

The metal surface to be phosphated is first degreased by dipping in and/or spraying with a known alkaline degreasing agent at 50° to 60° C. for a few minutes; washed washed with tap water and then with deionized water. Also, an acidic final chromate rinse can be employed before the rinse with deionized water.

In a preferred embodiment of the invention, use is made of a dipping procedure. In this embodiment, the acidic aqueous solution preferably contains (a') from about 0.5 to about 1.5 g/l, more preferably about 0.7 to about 1.2 g/l, of zinc ion;

(b') from about 5 to about 30 g/l, more preferably about 10 to about 20 g/l, of phosphate ion;

(c') from about 0.6 to about 3 g/l, more preferably about 0.8 to about 2 g/l, of manganese ion; and (d') the aforesaid conversion coating accelerator(s) in the quantities given above.

While these ranges are preferred, they can be adjusted within the broader limits stated above depending on the intended objects, materials and conditions used. However, certain general criteria for this dip process are useful here as follows: When the amount of zinc ion is less than about 0.5 g/l, an even phosphate film is usually not formed on an iron-based surface, and a partially blue-colored film is often formed. When the amount of zinc ion exceeds about 1.5 g/l, then though an even phosphate film is formed, the film formed on an iron-based surface tends to be in the form of leaf-like crystals, which are unsuitable as a substrate for cationic electrocoating. When the amount of phosphate ion in the solution is less than about 5 g/l, an uneven film results. When the amount of phosphate ion exceeds about 30 g/l, no further improvement in the phosphate film is realized and hence, while not harmful, use of phosphate ion above about 30 g/l is uneconomical. When the amount of manganese ion is less than about 0.6 g/l, the manganese content in the film formed on the zinc-based surface is insufficient, resulting in inadequate adhesivity of the coating film to the phosphate substrate after cationic electrocoating. When the amount of manganese ion exceeds about 3 g/l, no further improvement in the phosphate coating is realized, and hence, it is uneconomical to use amounts in excess of about 3 g/l.

With respect to the conversion coating accelerator(s) used in the solutions of the invention, when the amount of these accelerators is less than the lower amounts given above, the conversion coating on iron-based surfaces is inadequate, forming yellow rust, etc. When the amount of accelerator exceeds the higher amounts given above, a blue-colored uneven film is formed on iron-based surfaces. In another preferred embodiment of the invention, use is made of a spraying procedure. In this embodiment, the acidic aqueous solution of the invention can contain (a'') from about 0.1 to about 2.0 g/l, preferably about 0.5 to about 1.5 g/l, and more preferably about 0.7 to about 1.2 g/l, of zinc ion;

(b'') from about 5 to about 30 g/l, preferably about 10 to about 20 g/l, of phosphate ion;

(c'') from about 0.2 to about 3 g/l, and preferably about 0.6 to about 3 g/l, of manganese ion; and (d'') the aforesaid conversion coating accelerator(s) in the quantities given above.

Here again, the above ranges can be adjusted depending on the intended objects, materials and conditions used. However, when the amount of zinc ion is less than 0.1 g/l, an even phosphate film will seldom form on an iron-based surface, and a partially blue-colored film is formed. On the other hand, when the amount of zinc ion is in excess of 2.0 g/l, then the film tends to be in the form of leaf-like crystals and deficient in secondary adhesion, which renders it unsuitable as a substrate for cationic electrocoating. When the amount of phosphate ion in the solution is less than about 5 g/l, an uneven film results, whereas when the amount of phosphate ion exceeds 30 g/l, no further improvement in the phosphate film is realized and hence, the use of greater quantities of phosphate is uneconomical. When the amount of manganese ion is less than about 0.2 g/l, the manganese content in the film formed on the zinc-based surface is insufficient, resulting in inadequate adhesivity of the siccative coating film to the phosphate conversion coating after cationic electrocoating. When the amount of manganese ion exceeds 3 g/l, no further improvement in the phosphate coating is realized and hence, excess use thereof is uneconomical. Furthermore, spot rusting of iron-based surfaces will increase. With respect to the quantities of conversion coating accelerator(s), very similar results to those stated above in connection with the solution for dipping use are obtained.

In addition to the dipping and spray applications described above, certain commercial conditions may warrant contacting the metal surface with the coating solution in a combination of different methods, such as by intermittent spraying of the metal surface, by spraying followed by dipping, or by dipping followed by spraying. The coating composition can be applied by these methods without a loss in coating formation. For example, the coating solution can be applied by intermittent spray, where the metal substrate is sprayed for about 5 to about 30 seconds, then allowed to stand without any coating application for about 5 to about 30 seconds, and then sprayed for at least 5 seconds with a total spray time of at least 40 seconds. This cycle can be carried out once, twice or three times.

Furthermore, in treating metal components having complicated surface profiles, such as with car bodies, the components can be subjected first to dipping treatments for about 15 seconds or more, preferably about 30 to about 90 seconds, and then to spray treatment with the solution about 2 seconds or more, preferably about 5 to about 45 seconds. in order to wash out the sludge which adheres during dipping, the spray treatment is preferably carried out for as long a period within the above range as the speed of the production line will permit. Dipping application is preferred over spray application, with a dipping-spray application being most preferred. Alternatively, the coating can be applied by first spraying the metal surface for from about 2 to about 15 seconds, and then dipping the metal surface into the coating solution for at least about 15 seconds, preferably from about 90 to about 120 seconds. This method of applying the coating composition helps to eliminate "hash" marks on the metal surface as the metal surface enters the dip coating solution. The "hash" marks result when the conveyor system fails to move the substrate at a constant velocity, or when the substrate "sways" in a direction perpendicular to the direction of conveyor movement.

Of course, the above treating times and treating sequences can be changed according to the composition of the metal substrate to be treated and the treating solution and conditions to be used.

For spray applications, the coating solution is conveniently applied at a spraying pressure of from about 0.5 to about 2 $Kg/cm^2$.

Irrespective of the application means and the contacting solution used, the resulting phosphate film present on the zinc-based surface should preferably contain from about 1.0 to about 20% by weight, more preferably from about 2 to about 18% by weight, and most preferably from about 5 to about 18% by weight of manganese ion, which is very important for the subsequent cationic electrocoating. The zinc ion is present in from about 28 to about 45% by weight, preferably about 28 to about 40% by weight. When nickel ion is used in the solution, then from about 0.3 to about 4% by weight, preferably about 0.5 to about 4% by weight of nickel is present in the coating. The remainder of the coating is phosphate and water, except for quantities of other ions such as sodium, calcium, magnesium, etc. that total less than 1% by weight. It has also been found that as the content of manganese in the bath increases, increased manganese content in the coating results. However, increasing the manganese level of the coatings above the ranges given above does not improve coating quality.

As an example of a source of zinc ions for use in the practice of the invention, one or more of the following can be employed: zinc oxide, zinc carbonate, and zinc nitrate. As an example of a source of phosphate ions, one or more of the following can be used: sodium phosphate, zinc phosphate, and manganese phosphate. As an example of a source of manganese ions, one or more of the following can be employed: manganese carbonate, manganese nitrate, manganese chloride, and manganese phosphate. As an example of sources of conversion coating accelerators, sodium nitrite, ammonium nitrite, sodium m-nitrobenzene sulfonate, and hydrogen peroxide can be employed herein. With respect to the optional ingredients that can be added to the acidic aqueous solution of the invention, the addition of nickel ion to a manganese-containing composition results in further improvement in the performance of the phosphate conversion coating, so that the adhesion and the corrosion-resistance of the film produced by cationic electrocoating are also further improved.

As sources of the optional ingredients, nickel carbonate, nickel nitrate, nickel chloride, nickel phosphate etc. are used for nickel ions; sodium nitrate, ammonium nitrate, zinc nitrate, manganese nitrate, nickel nitrate, etc. for nitrate ions, and chloric acid, sodium chlorate, ammonium chlorate, etc. for chlorate ions.

The acidic aqueous treating solutions are conveniently prepared by diluting an aqueous concentrate which contains a number of the solution ingredients in proper weight ratios, and then adding other ingredients as needed to prepare the treating solutions of the invention. The concentrates are advantageously formulated to contain zinc ion, phosphate ion, and manganese ion, and optionally nickel ion, in a weight proportion of 0.1 to 2 : 5 to 30 : 0.2 to 3 : 0.1 to 4. The concentrates are preferably formulated to contain at least about 25 g/l, and more preferably from about 50 g/l, to about 130 g/l, of zinc ion.

The invention will be better understood from the following examples, which are given to illustrate the invention and not to limit it.

EXAMPLES I–XIV

Examples I through IX are examples of the process and compositions of the invention. Examples X through XIV are examples using known compositions, given for comparison purposes. The treating process used, which is common to all of EXAMPLES I–XIV, is given below, with the aqueous coating compositions of each example set forth in Table I, while the metal treated and the test results obtained following the phosphate treatment are given in Table 2.

Samples of all four metal surfaces given in Table 2 were treated simultaneously according to the following procedure:

(a) degreasing, using an alkaline degreasing agent ("RIDOLINE SD200", 2% by weight) which was sprayed on the metal surfaces at 60° C. for 1 minute, followed by dipping in the solution for 2 minutes;

(b) the metal surfaces were then washed with tap water at room temperature for 15 seconds;

(c) the metal surfaces were next dipped into a surface conditioner ("FIXODINE 5N5", 0.1% by weight) at room temperature for 15 seconds;

(d) the metal surfaces were then dipped into an acidic aqueous solution given in Table 1 at 52° C. for 120 seconds;

(e) the metal surfaces were washed with tap water at room temperature for 15 seconds;

(f) the metal surfaces were then dipped into deionized water at room temperature for 15 seconds;

(g) the surfaces were then dried in hot air at 100° C. for 10 minutes. At this stage the appearance and film weight of the treated metal surfaces was determined, with the results set forth in Table 2;

(h) a cationic electrocoating material (Nippon Paint Co., "Power Top U - 30 Dark Gray") was coated to 20 μ thickness onto the treated metal surfaces (voltage 180 V., treatment time 3 minutes), followed by baking at 180° C. for 30 minutes. One sample of each electrocoated plate so obtained was subjected to the brine spray test.

A second sample of each electrocoated plate so obtained was coated with an intermediate coating material (Nippon Paint Co., "ORGA T0778 Gray") to 30 μ thickness, followed by baking at 140° C. for 20 minutes, and a top coating material (Nippon Paint Co., "ORGA T0626 Margaret White") in 40 μ thickness was then applied, followed by baking as above. Accordingly, coated plates with a total of 3 coatings and 3 bakings were obtained. The coated plates were subjected to the adhesion test, and with the cold rolled steel plate, to the slot rusting test.

The testing procedures referred to above are described below:

(A) Brine spraying test (JIS-Z-2871):

Cross-cuts were made on an electrocoated plate; 5% brine was sprayed thereon for 500 hrs (zinc plated steel plate) or 1000 hrs (cold rolled steel plate).

(B) Adhesion test:

After dipping a coated plate in deionized water at 50° C. for 10 days, grids (100 squares) were made at 1 mm intervals or at 2 mm intervals using a sharp cutter; an adhesive tape was attached to each surface; and the number of squares of coating film that remained on the plate after the removal of the adhesive tape were counted.

(C) Spot rusting test:

A coated plate was set at a 15 degree angle to the horizontal plane, and an arrow with a cone shaped head with a 90 degree vertical angle, made of alloyed steel (material quality, JIS-G-4404, hardness Hv 700 or higher) weighing 1.00 g and 14.0 mm in total length was dropped repeatedly from a distance of 150 cm, until 25 scratches were made on the coated surface. Subsequently, the coated plate was subjected to 4 cycles of testing, each cycle consisting of first the brine spray test (JIS-Z-2871, 24 hrs), second, a moisture test (temperature of 40° C., relative humidity 85%, 120 hrs), and third, standing at room temperature (24 hrs). Test results are shown in Table 2.

TABLE 1

| Composition of Acidic Aqueous solution, g/l | Ex. I | Ex. II | EX. III | Ex. IV | EX. V | EX. VI | EX. VII | EX. VIII | EX. IX | EX. X | EX. XI | EX. XII | EX. XIII | EX. XIV |
|---|---|---|---|---|---|---|---|---|---|---|---|---|---|---|
| Zn | 1.0 | 1.0 | 1.0 | 1.0 | 1.0 | 1.0 | 1.0 | 0.7 | 1.2 | 0.69 | 0.8 | 1.0 | 1.0 | 3.0 |
| $PO_4$ | 14.0 | 14.0 | 14.0 | 14.0 | 14.0 | 14.0 | 14.0 | 10.0 | 20.0 | 11.40 | 14.0 | 14.0 | 14.0 | 20.0 |
| Mn | 0.8 | 2.0 | 2.0 | 0.8 | 0.8 | 2.0 | 0.8 | 0.8 | 0.8 | — | — | 0.5 | 0.3 | 0.8 |
| Ni | — | — | 2.0 | 0.3 | 2.0 | 0.3 | 0.3 | 0.3 | 0.3 | 0.38 | 0.5 | — | 0.3 | 0.3 |
| $NO_2$ | 0.06 | 0.06 | 0.06 | 0.06 | 0.06 | | | | | | | | | |
| Free Acid | 0.06 | — | 0.06 | 0.06 | 0.07 | 0.08 | 0.06 | 0.06 | 0.06 | | | | | |
| $H_2O_2$ | — | — | — | — | — | — | 1.0 | — | — | — | — | — | — | — |
| $NO_3$ | 4.0 | 4.0 | 4.0 | 4.0 | 4.0 | 4.0 | 4.0 | 4.0 | 4.0 | 1.6 | 3.0 | 4.0 | 4.0 | 4.0 |
| $ClO_3$ | 0.7 | 0.7 | 0.7 | 0.7 | 0.7 | 0.7 | 0.7 | 0.7 | 0.7 | 1.49 | 0.5 | 0.7 | 0.7 | 0.7 |
| $BF_4$ | — | — | — | — | — | — | — | — | — | 0.8 | — | — | — | — |
| Fe (III) | — | — | — | — | — | — | — | — | — | 0.018 | — | — | — | — |
| Total Acidity (point) | 17.5 | 19 | 19 | 18 | 20 | 19.5 | 18 | 18 | 24 | 14.5 | 17 | 17 | 17 | 26 |
| Acidity of (point) | 0.9 | 0.9 | 0.9 | 0.9 | 0.9 | 0.9 | 0.9 | 0.7 | 1.0 | 0.8 | 0.9 | 0.9 | 0.9 | 1 |

TABLE 2

| Metal | Test item | EX. I | EX. II | EX. III | EX. IV | EX. V | EX. VI | EX. VII |
|---|---|---|---|---|---|---|---|---|
| Hot dipped zinc alloy plated on | Film appearance | good evenness & density | good evenness & density | good evenness & density | good evenness & density | good evenness & density | good evenness & density | good evenness & density |
| | Film weight ($g/m^2$) | 3.2 | 2.8 | 2.6 | 3.0 | 3.1 | 2.7 | 3.2 |
| | Brine spray (ave. in mm) | 2.5 | 2.0 | 1.5 | 1.5 | 1.5 | 1.5 | 1.5 |

TABLE 2-continued

| | | | | | | | | |
|---|---|---|---|---|---|---|---|---|
| steel | Adhesivity | | | | | | | |
| plate | 2 mm cuts | 100/100 | 100/100 | 100/100 | 100/100 | 100/100 | 100/100 | 100/100 |
| | 1 mm cuts | 100/100 | 100/100 | 100/100 | 100/100 | 100/100 | 100/100 | 100/100 |
| Electro- | Film appearance | good evenness & density | good evenness & density | good evenness & density | good evenness & density | good evenness & density | good evenness & density | good evenness & density |
| plated zinc on steel plate | Film weight (g/m$^2$) | 2.5 | 2.0 | 2.4 | 2.2 | 2.4 | 2.4 | 2.1 |
| | Brine spray (ave. in mm) | 3.5 | 3.0 | 2.0 | 2.5 | 2.0 | 2.0 | 3.0 |
| | Adhesivity | | | | | | | |
| | 2 mm cuts | 100/100 | 100/100 | 100/100 | 100/100 | 100/100 | 100/100 | 100/100 |
| | 1 mm cuts | 80/100 | 90/100 | 100/100 | 95/100 | 100/100 | 100/100 | 100/100 |
| Electro- | Film appearance | good evenness & density | good evenness & density | good evenness & density | good evenness & density | good evenness & density | good evenness & density | good evenness & density |
| plated zinc alloy on steel plate | Film weight (g/m$^2$) | 3.2 | 2.9 | 2.6 | 3.1 | 3.2 | 2.8 | 3.0 |
| | Brine spray (ave. in mm) | 2.0 | 2.0 | 1.5 | 2.0 | 1.5 | 1.5 | 2.0 |
| | Adhesivity | | | | | | | |
| | 2 mm cuts | 100/100 | 100/100 | 100/100 | 100/100 | 100/100 | 100/100 | 100/100 |
| | 1 mm cuts | 100/100 | 100/100 | 100/100 | 100/100 | 100/100 | 100/100 | 100/100 |
| cold | Film appearance | good evenness & density | good evenness & density | good evenness & density | good evenness & density | good evenness & density | good evenness & density | good evenness & density |
| rolled steel plate | Film weight (g/m$^2$) | 2.5 | 2.2 | 2.2 | 2.3 | 2.2 | 2.0 | 2.2 |
| | Brine spray (ave. in mm) | 1.5 | 1 | >1 | 1 | 1≧ | 1 | 1 |
| | Adhesivity | | | | | | | |
| | 2 mm cuts | 100/100 | 100/100 | 100/100 | 100/100 | 100/100 | 100/100 | 100/100 |
| | 1 mm cuts | 100/100 | 100/100 | 100/100 | 100/100 | 100/100 | 100/100 | 100/100 |
| | Spot rusting (ave. in mm) | 0.96 | 1.00 | 0.88 | 0.98 | 0.91 | 0.96 | 0.97 |

| Metal | Test item | EX. VIII | EX. IX | EX. X | EX. XI | EX. XII | EX. XIII | EX. XIV |
|---|---|---|---|---|---|---|---|---|
| Hot | Film appearance | good evenness & density | good evenness & denstiy | good evenness & density | good evenness | good evenness | good evenness | good evenness |
| dipped zinc alloy plated on steel | Film weight (g/m$^2$) | 2.9 | 2.7 | 4.5 | 4.5 | 4.0 | 4.2 | 4.6 |
| | Brine spray (ave. in mm) | 1.5 | 1.5 | 5.5 | 3.5 | 4.0 | 3.5 | 4.0 |
| | Adhesivity | | | | | | | |
| plate | 2 mm cuts | 100/100 | 100/100 | 35/100 | 58/100 | 68/100 | 52/100 | 0/100 |
| | 1 mm cuts | 100/100 | 100/100 | 0/100 | 0/100 | 0/100 | 0/100 | 0/100 |
| Electro- | Film appearance | good evenness & density | good evenness & density | good evenness & density | good evenness | good evenness | good evenness | good evenness |
| plated zinc on steel plate | Film weight (gm$^2$) | 2.3 | 2.3 | 3.7 | 3.5 | 3.3 | 3.5 | 3.8 |
| | Brine spray (ave. in mm) | 2.5 | 2.5 | 10.5 | 6.5 | 6.0 | 7.0 | 8.0 |
| | Adhesivity | | | | | | | |
| | 2 mm cuts | 100/100 | 100/100 | 0/100 | 24/100 | 33/100 | 25/100 | 0/100 |
| | 1 mm cuts | 100/100 | 95/100 | 0/100 | 0/100 | 0/100 | 0/100 | 0/100 |
| Electro- | Film appearance | good evenness & density | good evenness & density | good evenness & density | good evenness | good evenness | good evenness | good evenness |
| plated zinc alloy on steel plate | Film weight (g/m$^2$) | 3.0 | 2.9 | 4.3 | 4.0 | 3.6 | 3.8 | 4.5 |
| | Brine spray (ave. in mm) | 2.0 | 2.0 | 5.0 | 3.0 | 3.0 | 3.5 | 3.0 |
| | Adhesivity | | | | | | | |
| | 2 mm cuts | 100/100 | 100/100 | 20/100 | 64/100 | 52/100 | 48/100 | 0/100 |
| | 1 mm cuts | 100/100 | 100/100 | 0/100 | 3/100 | 12/100 | 6/100 | 0/100 |
| cold | Film appearance | good evenness & density | good evenness & density | blue colored uneven | good evenness & density | good evenness & density | good evenness & density | good evenness |
| rolled steel plate | Film weight (g/m$^2$) | 2.2 | 2.0 | 0.8 | 3.1 | 2.9 | 3.0 | 3.4 |
| | Brine spray (ave. in mm) | 1 | 1 | 4 | 1.5 | 1.5 | 1.5 | 3.0 |
| | Adhesivity | | | | | | | |
| | 2 mm cuts | 100/100 | 100/100 | 100/100 | 100/100 | 100/100 | 100/100 | 0/100 |
| | 1 mm cuts | 100/100 | 100/100 | 80/100 | 100/100 | 100/100 | 100/100 | 0/100 |
| | Spot rusting (ave. in mm) | 0.96 | 0.98 | 8.10 | 1.10 | 1.30 | 1.30 | 2.52 |

In Table 2 above, brine spray and spot rusting each indicate average value (mm) of the largest diameter of blisters and rust spots, respectively.

EXAMPLES XV-XXXI

EXAMPLES XV through XXV are examples of the process and compositions of the invention. EXAM- PLES XXVI through XXXI are examples using known compositions, given for comparison purposes.

The treating process used, which is common to all of EXAMPLES XV–XXXI, is given below, with the aqueous coating composition of each example set forth in Table 3, while the metal treated and the test results obtained following the phosphate treatment are given in Table 4.

Samples of all four metal surfaces given in Table 4 were treated simultaneously according to the following procedure:

(a) degreasing, using an alkaline degreasing agent ("RIDOLINE S102", 2% by weight) which was sprayed on the metal surfaces at 60° C. for 2 minutes;

(b) the metal surfaces were then washed with tap water at room temperature for 15 seconds;

(c) the metal surfaces where then sprayed with an acidic aqueous solution given in Table 3 at 52° C. for 120 seconds, (in EX. XXVI, first sprayed for 15 seconds, discountinued spraying for 15 seconds, and again sprayed for 105 seconds) spraying pressure −0.8 $Kg/cm^2$ (gauge pressure);

(d) the metal surfaces were washed with tap water at room temperature for 15 seconds;

(e) the metal surfaces were then dipped into deionized water at room temperature for 15 seconds;

(f) the surfaces were then dried in hot air at 100° C. for 10 minutes. At this stage the appearance and film weight of the treated metal surfaces was determined, with the results set forth in Table 4;

(g) a cationic electrocoating material (Nippon Paint Co., "Power Top U-30 Dark Gray") was coated to 20 μ thickness onto the treated metal surfaces (voltage 180 V., treatment time 3 minutes), followed by baking at 180° C. for 30 minutes. One sample of each electrocoated plate so obtained was subjected to the brine spray test.

A second sample of each electrocoated plate so obtained was coated with an intermediate coating material (Nippon Paint Co., "ORGA T0778 Gray") to 30 μ thickness, followed by baking at 140° C. for 20 minutes, and a top coating material (Nippon Paint Co., "ORGA T0626 Margaret White") in 40 μ thickness was then applied, followed by baking as above. Accordingly, coated plates with a total of 3 coatings and 3 bakings were obtained. The coated plates were subjected to the adhesion test, and with the cold rolled steel plate, to the spot rusting test.

The testing procedures referred to above are described below:

(A) Brine spraying test (JIS-Z-2871):

Cross-cuts were made on an electrocoated plate; 5% brine was sprayed thereon for 500 hrs (zinc plated steel plate) or 1000 hrs (cold rolled steel plate).

(B) Adhesion test:

After dipping a coated plate in deionized water at 50° C. for 10 days, grids (100 squares) were made at 1 mm intervals or at 2 mm intervals using a sharp cutter; an adhesive tape was attached to each surface; and the number of squares of coating film that remained on the plate after the removal of the adhesive tape were counted.

(C) Spot rusting test:

A coated plate was set at a 15 degree angle to the horizontal plane, and an arrow with a cone shaped head with a 90 degree vertical angle, made of alloyed steel (material JIS-G-4404, hardness Hv 700 or higher) weighing 1.00 g and 14.0 mm total length was dropped repeatedly from a distance of 150 cm, until 25 scratches were made on the coated surface. Subsequently the coated plate was subjected to 4 cycles of testing, each cycle consisting of first the brine spray test (JIS-Z-2871, 24 hrs), second a moisture test (temperature of 40° C., relative humidity 85%, 120 hrs), and third, standing at room temperature (24 hrs). After testing, the average value (mm) of the largest diameter of rust spots and blisters was obtained, with the results shown in Table 4.

(D) Determination of Mn in coating.

A phosphated plate was dipped in a 5% aqueous chromic acid solution (75° C.) for 5 minutes and the weight of the conversion coating was calculated from the weight difference of the plate before and after said treatment. Next, the amount of manganese dissolved out and contained in the said aqueous chromic acid was determined by the atomic-absorption method and manganese in the conversion coating was calculated therefrom.

$$\text{Mn(\%) in the conversion coating (\%)} = W_M/Wc \times 100$$

$$Wc = W_1 - W_2/S$$

$$W_M = A.M/S$$

wherein $W_1$ stands for weight (g) of plate before chromic acid treatment;

$W_2$ stands for weight (g) of plate after chromic acid treatment;

S is surface area ($m^2$) of plate;

Wc is the coating weight per square meter ($g/m^2$);

A stands for volume (l) of chromic acid solution used;

M stands for amount of Mn determined by atomic-absorption method (g/l); and $W_M$ nds for amount of Mn in unit area ($m^2$) of coating.

TABLE 3

| Composition of Acidic Aqueous solution, g/l | Ex. XV | Ex. XVI | Ex. XVII | EX. XVIII | EX. XIX | EX. XX | EX. XXI | EX. XXII |
|---|---|---|---|---|---|---|---|---|
| Zn | 1.0 | 1.0 | 1.0 | 1.0 | 1.0 | 1.0 | 0.7 | 1.2 |
| $PO_4$ | 14.0 | 14.0 | 14.0 | 14.0 | 14.0 | 14.0 | 10.0 | 20.0 |
| Mn | 0.8 | 2.0 | 0.8 | 0.8 | 2.0 | 0.8 | 0.8 | 0.8 |
| Ni | — | — | 0.3 | 2.0 | 0.3 | 0.3 | 0.3 | 0.3 |
| $NO_2$ | 0.06 | 0.06 | 0.06 | 0.06 | 0.06 | — | 0.06 | 0.06 |
| $H_2O_2$ | — | — | — | — | — | 1.0 | — | — |
| $NO_3$ | 4.0 | 4.0 | 4.0 | 4.0 | 4.0 | 4.0 | 4.0 | 4.0 |
| $ClO_3$ | 1.5 | 1.5 | 1.5 | 1.5 | 1.5 | 1.5 | 1.5 | 1.5 |
| $BF_4$ | — | — | — | — | — | — | — | — |
| Fe (III) | — | — | — | — | — | — | — | — |

TABLE 3-continued

| | | | | | | | | |
|---|---|---|---|---|---|---|---|---|
| Total Acidity (point) | 17.5 | 19 | 18 | 20 | 19.5 | 18 | 18 | 24 |
| Acidity of Free Acid (point) | 0.7 | 0.7 | 0.7 | 0.7 | 0.7 | 0.7 | 0.6 | 0.7 |
| Spraying pressure ($Kg/cm^2$) | 0.8 | 0.8 | 0.8 | 0.8 | 0.8 | 0.8 | 0.8 | 0.8 |
| Composition of Acidic Aqueous solution, g/l | Ex. XXIII | Ex. XXIV | Ex. XXVI | EX. XXVII | EX. XXVIII | EX. XXIX | EX. XXX | EX. XXXI |
| Zn | 1.0 | 1.2 | 0.69 | 0.8 | 1.0 | 1.0 | 3.0 | 0.1 |
| $PO_4$ | 14.0 | 20.0 | 11.4 | 14.0 | 14.0 | 14.0 | 20.0 | 5.0 |
| Mn | 0.8 | 0.8 | — | — | 0.5 | 0.3 | 0.8 | 0.8 |
| Ni | 0.3 | 0.3 | 0.38 | 0.5 | — | 0.3 | 0.3 | 0.3 |
| $NO_2$ | 0.08 | 0.06 | 0.07 | 0.08 | 0.06 | 0.06 | 0.06 | 0.06 |
| $H_2O_2$ | — | — | — | — | — | — | — | — |
| $NO_3$ | 4.0 | 4.0 | 1.6 | 3.0 | 4.0 | 4.0 | 4.0 | 4.0 |
| $ClO_3$ | — | 2.5 | 1.49 | 0.5 | 1.5 | 1.5 | 1.5 | 0.3 |
| $BF_4$ | — | — | 0.8 | — | — | — | — | — |
| Fe (III) | — | — | 0.018 | — | — | — | — | — |
| Total Acidity (point) | 18 | 24 | 14.5 | 17 | 17 | 17 | 26 | 8 |
| Acidity of Free Acid (point) | 0.7 | 0.7 | 0.6 | 0.7 | 0.7 | 0.7 | 0.7 | 0.2 |
| Spray. pressure ($Kg/cm^2$) | 0.8 | 0.8 | 0.8 | 0.8 | 0.8 | 0.8 | 0.8 | 0.8 |

In Example XXV, the same composition as given in Example XV was used, but intermittent spraying, i.e., spraying (15 sec)-standing (15 sec.)-spraying (105 sec.) was used.

TABLE 4

| Metal | Test item | EX. XV | EX. XVI | EX. XVII | EX. XVIII | EX. XIX | EX. XX | EX. XXI | EX. XXII | EX. XXIV | EX. XXV |
|---|---|---|---|---|---|---|---|---|---|---|---|
| Hot dipped zinc alloy plated on steel plate | Film appearance | good evenness & density | good evenness & density | good evenness & density | good evenness & density | good evenness & density | good evenness & density | good evenness & density | good evenness & density | good evenness & density | good evenness & density |
| | Film weight ($g/m^2$) | 2.6 | 2.2 | 2.4 | 2.5 | 2.2 | 2.6 | 2.3 | 2.2 | 2.0 | 2.2 |
| | Brine spray (ave. in mm) | 2.5 | 2.0 | 1.5 | 1.5 | 1.5 | 1.5 | 1.5 | 1.5 | 3.0 | 1.5 |
| | Adhesivity | | | | | | | | | | |
| | 2 mm cuts | 100/100 | 100/100 | 100/100 | 100/100 | 100/100 | 100/100 | 100/100 | 100/100 | 100/100 | 100/100 |
| | 1 mm cuts | 100/100 | 100/100 | 100/100 | 100/100 | 100/100 | 100/100 | 100/100 | 100/100 | 100/100 | 100/100 |
| Electro-plated zinc on steel plate | Film appearance | good evenness & density | good evenness & density | good evenness & density | good evenness & density | good evenness & density | good evenness & density | good evenness & density | good evenness & density | good evenness & density | good evenness & density |
| | Film weight ($g/m^2$) | 2.0 | 1.6 | 1.8 | 1.9 | 1.9 | 1.7 | 1.8 | 1.8 | 1.7 | 1.8 |
| | Brine spray (ave. in mm) | 3.5 | 3.0 | 2.5 | 2.0 | 2.0 | 3.0 | 2.5 | 2.5 | 4.0 | 2.0 |
| | Adhesivity | | | | | | | | | | |
| | 2 mm cuts | 100/100 | 100/100 | 100/100 | 100/100 | 100/100 | 100/100 | 100/100 | 100/100 | 90/100 | 100/100 |
| | 1 mm cuts | 80/100 | 90/100 | 95/100 | 100/100 | 100/100 | 100/100 | 100/100 | 95/100 | 80/100 | 100/100 |
| Electro-plated zinc alloy on steel plate | Film appearance | good evenness & density | good evenness & density | good evenness & density | good evenness & density | good evenness & density | good evenness & density | good evenness & density | good evenness & density | good evenness & density | good evenness & density |
| | Film weight ($g/m^2$) | 2.6 | 2.3 | 2.5 | 2.6 | 2.2 | 2.4 | 2.4 | 2.3 | 2.2 | 2.0 |
| | Brine spray (ave. in mm) | 2.0 | 2.0 | 2.0 | 1.5 | 1.5 | 2.0 | 2.0 | 2.0 | 2.5 | 1.5 |
| | Adhesivity | | | | | | | | | | |
| | 2 mm cuts | 100/100 | 100/100 | 100/100 | 100/100 | 100/100 | 100/100 | 100/100 | 100/100 | 100/100 | 100/100 |
| | 1 mm cuts | 100/100 | 100/100 | 100/100 | 100/100 | 100/100 | 100/100 | 100/100 | 100/100 | 95/100 | 100/100 |
| cold rolled steel plate | Film appearance | good evenness & density | good evenness & density | good evenness & density | good evenness & density | good evenness & density | good evenness & density | good evenness & density | good evenness & density | good evenness & density | good evenness & density |
| | Film weight ($g/m^2$) | 1.8 | 1.5 | 1.8 | 1.8 | 1.6 | 1.8 | 1.8 | 1.6 | 1.5 | 1.6 |
| | Brine spray (ave. in mm) | 2.0 | 1.5 | 1.5 | 1.0 | 1.5 | 1.5 | 1.5 | 1.5 | 2.0 | 1.02 |
| | Adhesivity | | | | | | | | | | |
| | 2 mm cuts | 100/100 | 100/100 | 100/100 | 100/100 | 100/100 | 100/100 | 100/100 | 100/100 | 100/100 | 100/100 |
| | 1 mm cuts | 100/100 | 100/100 | 100/100 | 100/100 | 100/100 | 100/100 | 100/100 | 100/100 | 100/100 | 100/100 |
| | Spot rusting (ave. in mm) | 0.96 | 1.00 | 0.98 | 0.91 | 0.96 | 0.97 | 0.96 | 0.98 | 0.98 | 0.87 |

| Metal | Test item | EX. XXVI | EX. XXVII | EX. XXVIII | EX. XXIV | EX. XXIII | EX. XXX | EX. XXXI |
|---|---|---|---|---|---|---|---|---|
| Hot dipped zinc alloy plated on steel plate | Film appearance | good evenness & density | good evenness | good evenness | good evenness | good evenness & density | good evenness | good evenness |
| | Film weight ($g/m^2$) | 3.5 | 3.6 | 3.2 | 3.4 | 2.4 | 3.7 | 2.0 |
| | Brine spray (ave. in mm) | 5.5 | 3.5 | 4.0 | 3.5 | 2.5 | 4.0 | 4.5 |
| | Adhesivity | | | | | | | |
| | 2 mm cuts | 35/100 | 58/100 | 68/100 | 52/100 | 100/100 | 0/100 | 60/100 |
| | 1 mm cuts | 0/100 | 0/100 | 0/100 | 0/100 | 100/100 | 0/100 | 0/100 |
| Electro-plated zinc on steel plate | Film appearance | good evenness & density | good evenness | good evenness | good evenness | good evenness & density | good evenness | good evenness |
| | Film weight ($g/m^2$) | 3.0 | 2.8 | 3.0 | 2.8 | 1.9 | 3.0 | 1.8 |
| | Brine spray (ave. in mm) | 10.5 | 6.5 | 6.0 | 7.0 | 3.5 | 8.6 | 7.5 |

TABLE 4-continued

| | | | | | | | | |
|---|---|---|---|---|---|---|---|---|
| | | Adhesivity | | | | | | |
| | | 2 mm cuts | 0/100 | 24/100 | 33/100 | 25/100 | 100/100 | 0/100 | 34/100 |
| | | 1 mm cuts | 0/100 | 0/100 | 0/100 | 0/100 | 95/100 | 0/100 | 0/100 |
| | Electro-plated zinc alloy on steel plate | Film appearance | good evenness & density | good evenness | good evenness | good evenness | good evenness & density | good eveness | good evenness |
| | | Film weight ($g/m^2$) | 3.4 | 3.2 | 2.9 | 3.0 | 2.2 | 3.6 | 2.2 |
| | | Brine spray (ave. in mm) | 5.0 | 3.0 | 3.0 | 3.5 | 2.5 | 3.0 | 4.0 |
| | | Adhesivity | | | | | | | |
| | | 2 mm cuts | 20/100 | 64/100 | 52/100 | 48/100 | 100/100 | 0/100 | 68/100 |
| | | 1 mm cuts | 0/100 | 8/100 | 12/100 | 6/100 | 100/100 | 0/100 | 12/100 |
| | cold rolled steel plate | Film appearance | blue color uneven | good evenness & density | good evenness & density | good evenness & density | good evenness & density | good evenness | yellow rust uneven |
| | | Film weight ($g/m^2$) | 0.7 | 2.5 | 2.3 | 2.4 | 1.2 | 2.2 | 1.1 |
| | | Brine spray (ave. in mm) | 4.5 | 2.0 | 2.0 | 2.0 | 2.0 | 3.5 | 4.5 |
| | | Adhesivity | | | | | | | |
| | | 2 mm cuts | 100/100 | 100/100 | 100/100 | 100/100 | 100/100 | 0/100 | 80/100 |
| | | 1 mm cuts | 80/100 | 100/100 | 100/100 | 100/100 | 100/100 | 0/100 | 30/100 |
| | | Spot rusting (ave. in mm) | 3.10 | 1.10 | 1.30 | 1.30 | 1.00 | 4.52 | 5.02 |

What is claimed is:

1. A process for phosphating a metal surface comprising contacting the metal surface with an acidic aqueous solution consisting essentially of (a) from about 0.1 to about 2.0 g/l of zinc ion, (b) from about 5 to about 30 g/l of phosphate ion, (c) from about 0.2 to about 3 g/l of manganese ion, (d) a conversion coating accelerator which is a combination of (i) from about 0.01 to about 0.2 g/l of nitrite ion, and (ii) from about 0.05 to about 1.9 g/l of chlorate ion, and (f) from about 1 to about 10 g/l of nitrate ion.

2. A process according to claim 1 wherein said contact is carried out by dipping the metal surface in the solution.

3. A process according to claim 1 wherein said contact is carried out by spraying the metal surface with the solution.

4. A process according to claim 1 wherein said contact is carried out by a combination of dipping and spraying treatments.

5. A process according to claim 2 wherein the acidic aqueous solution contains (a) from about 0.5 to about 1.5 g/l of zinc ion;

(b) from about 5 to about 30 g/l phosphate ion; and (c) from about 0.6 to about 3 g/l of manganese ion.

6. A process according to claim 5 wherein the solution contains (a) from about 0.7 to about 1.2 g/l of zinc ion;

(b) from about 10 to 20 g/l of phosphate ion; and (c) from about 0.8 to about 2 g/l of manganese ion.

7. A process according to claim 3 wherein the solution contains (a) from about 0.5 to about 1.5 g/l of zinc ion;

(b) from about 10 to about 20 g/l of phosphate ion; and (c) from about 0.6 to about 3 g/l of manganese ion.

8. A process according to claim 1 wherein from about 0.1 to about 4 g/l of nickel ion is also present in the solution.

9. A process according to claim 1 wherein the treating temperature is from about 40° to about 70° C.

10. A process according to claim 3 wherein the treatment is carried out for at least 5 seconds.

11. A process according to claim 2 wherein the treatment is carried out by a dip treatment for at least 15 seconds, followed by a spray treatment for at least 2 seconds.

12. A process according to claim 3 wherein the treatment is carried out by a spray treatment for from about 2 to about 15 seconds, followed by/ a dip teatment for at least 15 seconds.

13. A process according to claim 3 wherein the treatment is carried out by one to threee intermittent spray cycles, each cycle consisting of first spraying for about 5 to about 30 seconds, then discontinuing spraying for about 5 to about 30 seconds, and then finally spraying again for at least about 5 seconds, wherein the total spray treatment time or each cycle is at least 40 seconds.

14. A process according to claim 1 wherein the metal surface includes both an iron-based surface and a zinc-based surface.

15. A process according to claim 1 wherein following said process, the metal surface is rinsed and electrocoated.

16. An acidic aqueous composition for phosphating a metal surface consisting essentially of:

(a) from about 0.1 to about 2.0 g/l of zinc ion;

(b) from about 5 to about 30 g/l of phosphate ion;

(c) from about 0.2 to about 3 g/l of manganese ion; and (d) a conversion coating accelerator which is a combination of (i) from about 0.01 to about 0.2 g/l of nitrite ion, and (ii) from about 0.05 to about 1.9 g/l of chlorate, and (f) from about 1 to about 10 g/l of nitrate ion.

17. A composition according to claim 16 wherein the zinc ion content is from about 0.5 to about 1.5 g/l and the manganese ion content is from about 0.6 to about 3 g/l.

18. A composition according to claim 16 wherein the zinc ion content is from about 0.7 to about 1.2 g/l.

19. A composition according to claim 16 wherein the composition also contains:

(e) from about 0.1 to about 4 g/l of nickel ion.

* * * * *